US005708695A

United States Patent [19]

Deucher et al.

[11] Patent Number: 5,708,695

[45] Date of Patent: Jan. 13, 1998

[54] ELECTRICAL COUPLING OF ROTATING MEMBERS OF MEDICAL IMAGING DEVICES

[75] Inventors: Joseph S. Deucher, Lyndhurst; Anton Z. Zupancic, Kirtland, both of Ohio

[73] Assignee: Picker International, Inc., Highland Heights, Ohio

[21] Appl. No.: 686,334

[22] Filed: Jul. 25, 1996

[51] Int. Cl.$^6$ ..... H01J 35/10

[52] U.S. Cl. ..... 378/125; 378/119

[58] Field of Search ..... 378/125

[56] References Cited

PUBLICATIONS

Honeywell Brochure entitled "Power and Data Transfer" (4 pages) Dated: Sep. 1994.

*Primary Examiner*—Craig E. Church

*Attorney, Agent, or Firm*—Fay, Sharpe, Beall, Fagan, Minnich & McKee

[57] ABSTRACT

An anode (16), (16') and a cathode (14), (14') are mounted in an evacuated envelope (12), (12') of an x-ray tube (10). One of the anode and cathode is rotatably mounted on bearings (20), (20') relative to the evacuated envelope. In the embodiment in which the anode is rotatably mounted relative to the evacuated housing, a rolling ring assembly (40) provides a current path from the anode through the evacuated housing to ground without the current path passing through the bearing (20). In this manner, pitting and other damage to the bearing due to arcing is eliminated. In the embodiment in which the cathode is rotatably mounted relative to the evacuated envelope, the anode and envelope rotate as the cathode is held stationary (58, 60). A plurality of rolling ring assemblies (40'$_1$, 40'$_2$, . . . ) provide electrical communication between electrical control circuitry disposed outside the rotating housing and the cathode assembly (14'). The electrical communication includes providing current to filaments of cathodes (30'$_1$, 30'$_2$) of the cathode assembly.

16 Claims, 5 Drawing Sheets

ELECTRICAL COUPLING OF ROTATING MEMBERS OF MEDICAL IMAGING DEVICES

BACKGROUND OF THE INVENTION

The present invention relates to the x-ray tube art. It finds particular application in conjunction with high power, rotating anode x-ray tubes such as used with CT scanners and will be described with particular reference thereto. It will be appreciated, however, that the invention will also find application in lower power rotating anode x-ray tubes, rotating cathode x-ray tubes, and the like.

Heretofore, rotating anode x-ray tubes have included an evacuated envelope which holds the anode and cathode. A disk-like anode and an elongated central shaft are rotatably mounted in a set of greaseless bearings within the vacuum.

A high voltage, applied between the rotating anode and an oppositely disposed cathode, causes electrons emitted by the cathode to strike the anode and generate x-rays. These electrons flow through the metallic anode, its central shaft, and the metallic bearings to ground. As this current flows from the rotating bearing race through the rolling interface to the bearing balls or rollers and through the further interface between the balls and rollers to the stationary bearing race, there is a tendency to arc. During arcing, a small amount of material is transferred from one surface to another causing a pit and a lump or other surface irregularities. As surface irregularities in the bearing contact the race and as surface irregularities in the race contact the bearing or roller, damage is caused to their smooth, polished surfaces. Moreover, the surface irregularities cause a wobble in the bearings. This wobble not only causes an undesirable wobble in the rotating anode, but also increases the probability for more arcing in the bearings. Of course, more arcing causes more surface irregularities accelerating failure of the bearings and the x-ray tube.

The present invention provides a new and improved apparatus and method which overcomes the above-referenced problems and others.

SUMMARY OF THE INVENTION

An x-ray tube has an evacuated envelope, a cathode mounted within the envelope and a rotating anode mounted within the evacuated envelope opposite the cathode. A shaft is connected to the anode and rotatably supported in a bearing assembly. The shaft defines an electrically conductive path for carrying electrons received by the anode from the cathode. A roll ring assembly, electrically connected between either the shaft or the anode and the evacuated envelope, provides an electrically conductive path which carries electrons from the anode to an exterior of the evacuated envelope. Bearings are disposed between the shaft and the x-ray tube for allowing the shaft to rotate. Electrons are emitted from the cathode and received by the anode. X-rays are emitted at a point on the anode where the electrons are received.

In accordance with one aspect of the invention, a current of electrons is propelled from the cathode to the anode with sufficient energy to produce x-rays at the anode where the current impacts the anode. The anode is rotated while the cathode is held stationary. An electrical current passes through a rolling ring between the evacuated envelope and either the cathode or the anode which is rotatably mounted relative thereto.

In accordance with another aspect of the invention, the current of electrons is passed through the anode, the shaft, a rotating track connected to the shaft, the rolling ring, and to ground.

In accordance with another aspect of the invention, the anode is mounted to the evacuated envelope such that the anode and envelope rotate together and the cathode is rotatably supported within the envelope such that the cathode remains stationary as the anode and evacuated envelope rotate.

One advantage of the present invention is that it reduces arcing across the bearings which in turn reduces "pitting" and metal fatigue.

Another advantage of the present invention is that the noise level from the bearings is reduced.

Another advantage of the present invention is that it has an increased current carrying capacity relative to bearings.

Another advantage of the present invention is that its performance is independent of bearing speed.

Another advantage of the present invention is that non-metallic bearings can be utilized.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
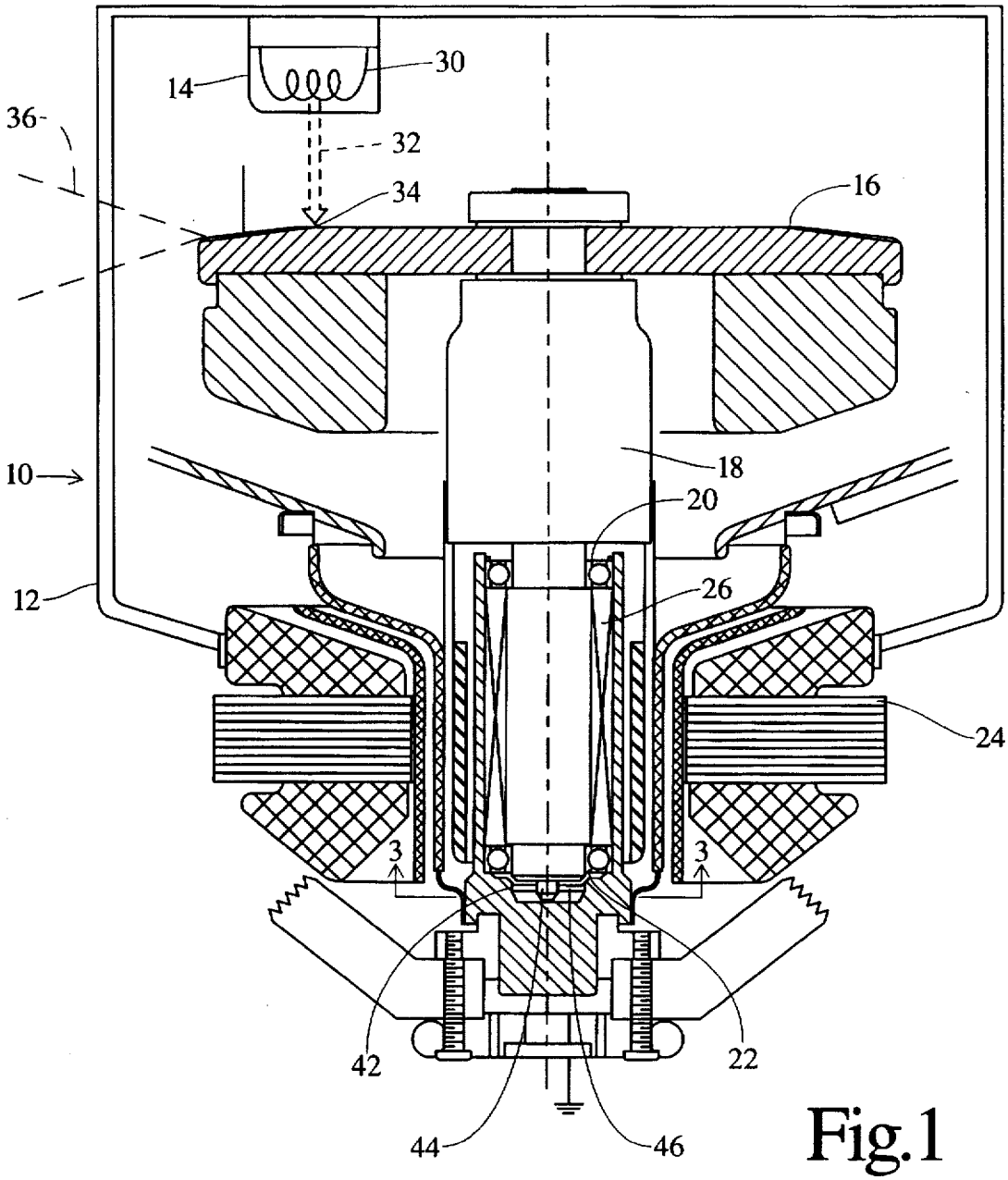
FIG. 1 is a cross-sectional view of an x-ray tube in accordance with the present invention.
Figure 2:
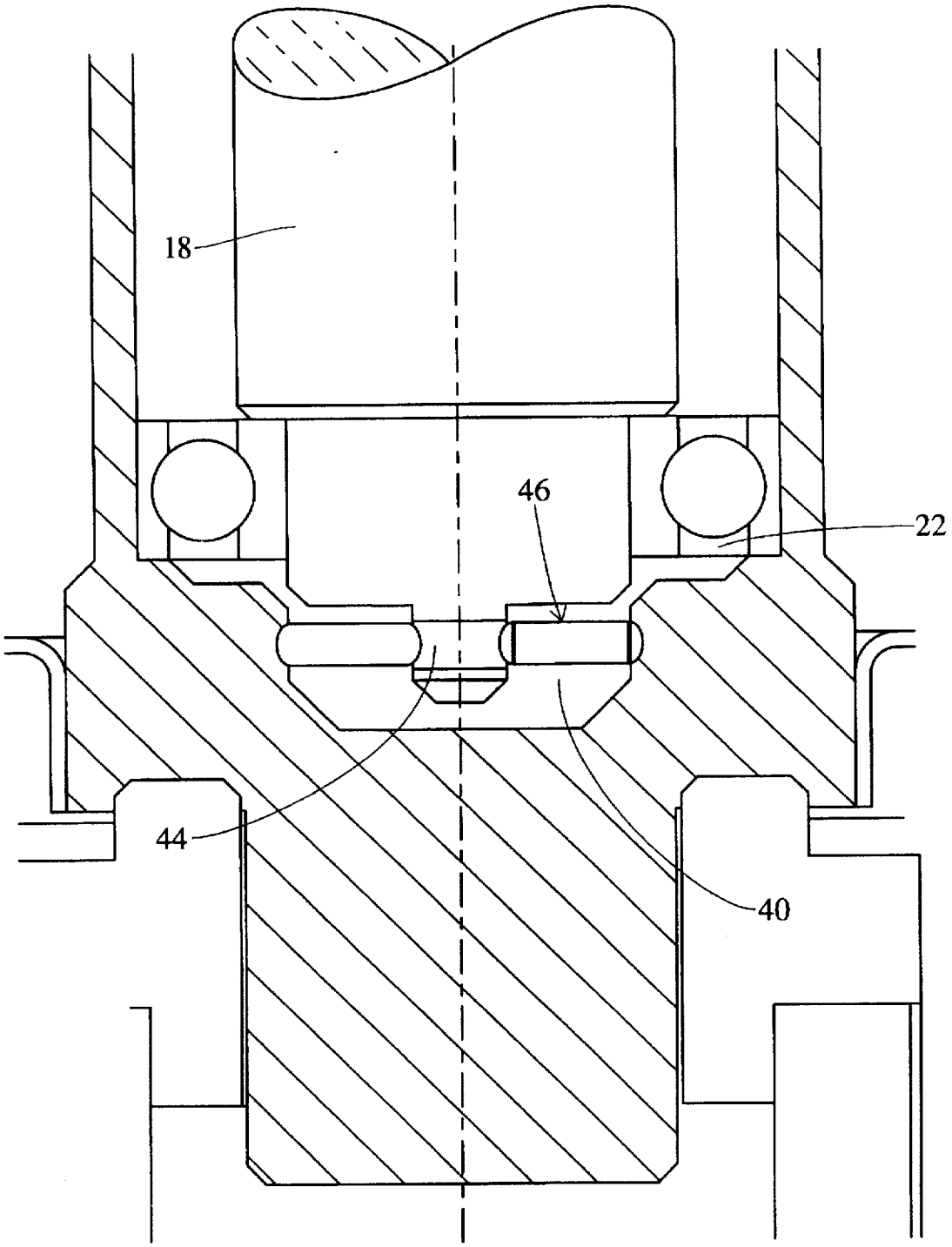
FIG. 2 is an enlarged cross-sectional view of the x-ray tube illustrated in FIG. 1.

With reference to FIGS. 1 and 2, an x-ray tube 10 has an evacuated envelope 12 that houses a cathode 14 and an anode 16. The anode 16 is connected to a central extended metal shaft 18. The central shaft is rotatably supported in a set of bearings, including an upper greaseless ball or roller bearing 20 and a lower ball or roller bearing 22. Each bearing includes a rotating race which is affixed to and rotates with the central shaft 18 and a stationary, outer race which is mounted to the evacuated envelope 12. A ring of balls or rollers are disposed between the races.

An induction motor rotates the anode 16. More specifically, a starter coil 24 is stationarily mounted outside of the evacuated envelope 12 and a rotor coil 26 is mounted to the central shaft 18 within the evacuated envelope 12. Of course, other types of motors are also contemplated.

The cathode 14 includes a cathode filament 30 through which a heating or filament current is passed. This current heats the filament 30 sufficiently that a cloud of electrons is emitted, i.e. thermionic emission occurs. A high potential, typically on the order of 100–200 kV, is applied between the cathode 14 and the anode 16. This potential causes a tube current of electrons 32 to flow from the cathode 14 to the anode 16. The electron beam 32 strikes on a small area, or a focal spot 34 on a peripheral track of the anode 16 with sufficient energy that x-rays 36 are generated and extreme heat is produced as a byproduct.

The anode 16 is rotated at a high speed (e.g., 3,000 to 10,000 rpm) such that the electron beam does not dwell on the focal point spot 34 long enough to cause thermal deformation. The diameter of the anode 16 is sufficiently large that in one rotation, each spot on the anode 16 that was heated by the electron beam 32 has substantially cooled before returning to be reheated by the electron beam. Larger diameter anodes have larger circumferences, and hence permit greater thermal loading. Typically, anode diameters are in the range of 7.5 to 17.5 cm.

After striking the anode 16, the electrons flow through the anode 16, the central shaft 18, a roll ring electrical connection 40 before reaching ground.

Figure 3:
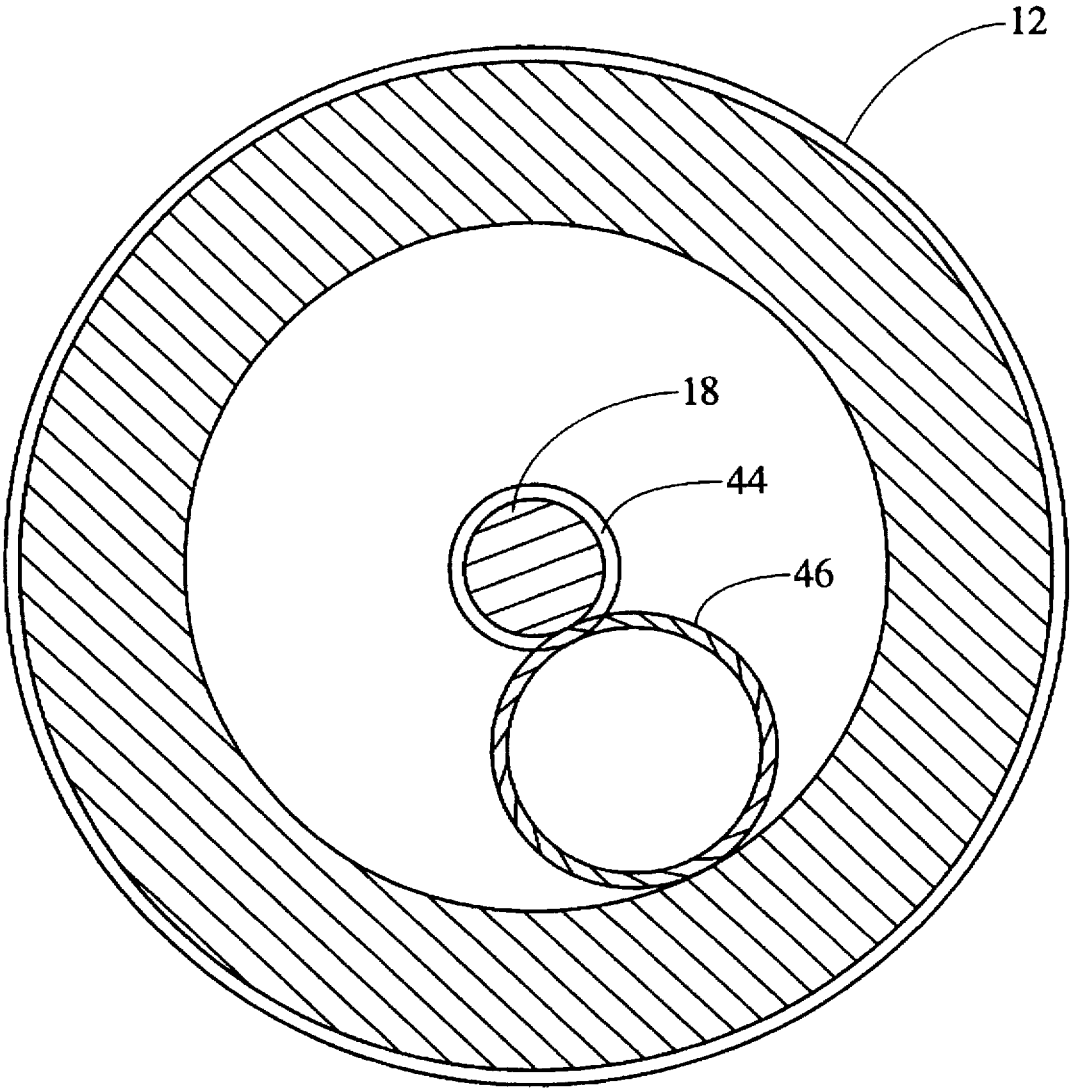
FIG. 3 is a sectional view through section 3—3 of FIG. 1.

With continuing reference to FIGS. 1 and 2 and further reference to FIG. 3, the roll ring assembly includes a stationary race 42 extending around an interior surface of the evacuated envelope 12. A matching race 44 is cut in or supported on the central shaft 18. A circular loop or ring 46 of conductive spring material is mounted in a slightly compressed condition between races 42 and 44. The deformation of the ring 46 urges the ring into firm frictional contact with both races to provide arc free electrical communication therebetween. The compression is sufficient that the rolling ring cuts through any slight surface oxidation which may form, yet sufficiently small that it does not cause the central shaft 18 or anode 16 to cant. As the inner race 44 rotates, a firm frictional connection with the rolling ring 46 causes the ring to rotate, without sliding. Similarly, firm frictional contact between the ring and the outer race causes the ring to rotate relative to it. Due to the different path lengths of the inner and outer races, the ring migrates around the central shaft during rotation.

Figure 4:
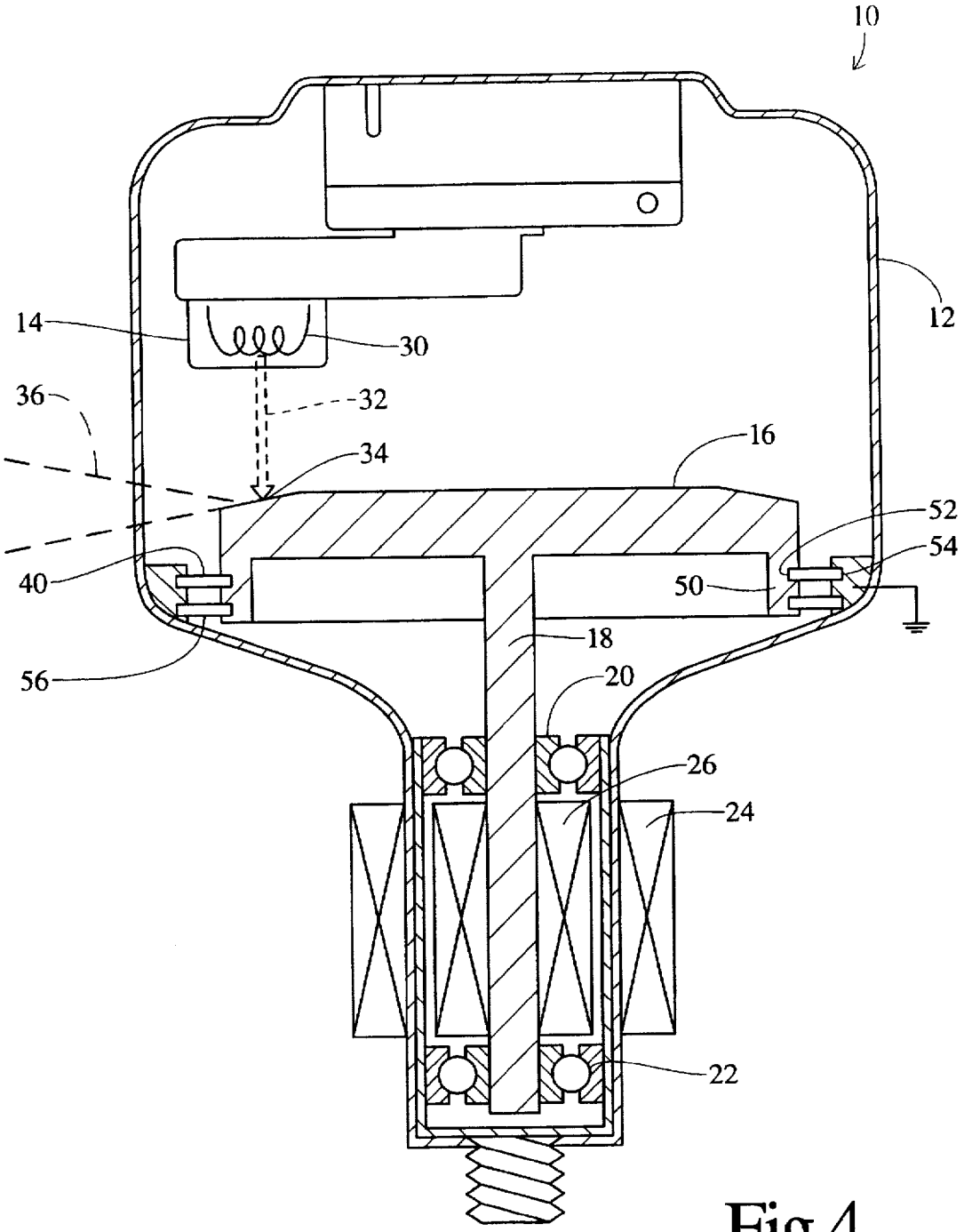
FIG. 4 is a cross-sectional view of another embodiment of an x-ray tube in accordance with the present invention.

With reference to FIG. 4, the roll ring assembly 40 can be disposed most anywhere between the anode 16 or shaft 18 and a race or track on the envelope 12. In the illustrated embodiment, a metal flange 50 with a rotating race or track 52 is connected around the anode 16. A stationary track or race 54 extends around the evacuated envelope 12. Optionally, one or more additional roll ring assemblies 56 can be provided for electrical redundancy and to provide additional thermal paths from the anode to accelerate cooling.

Figure 5:
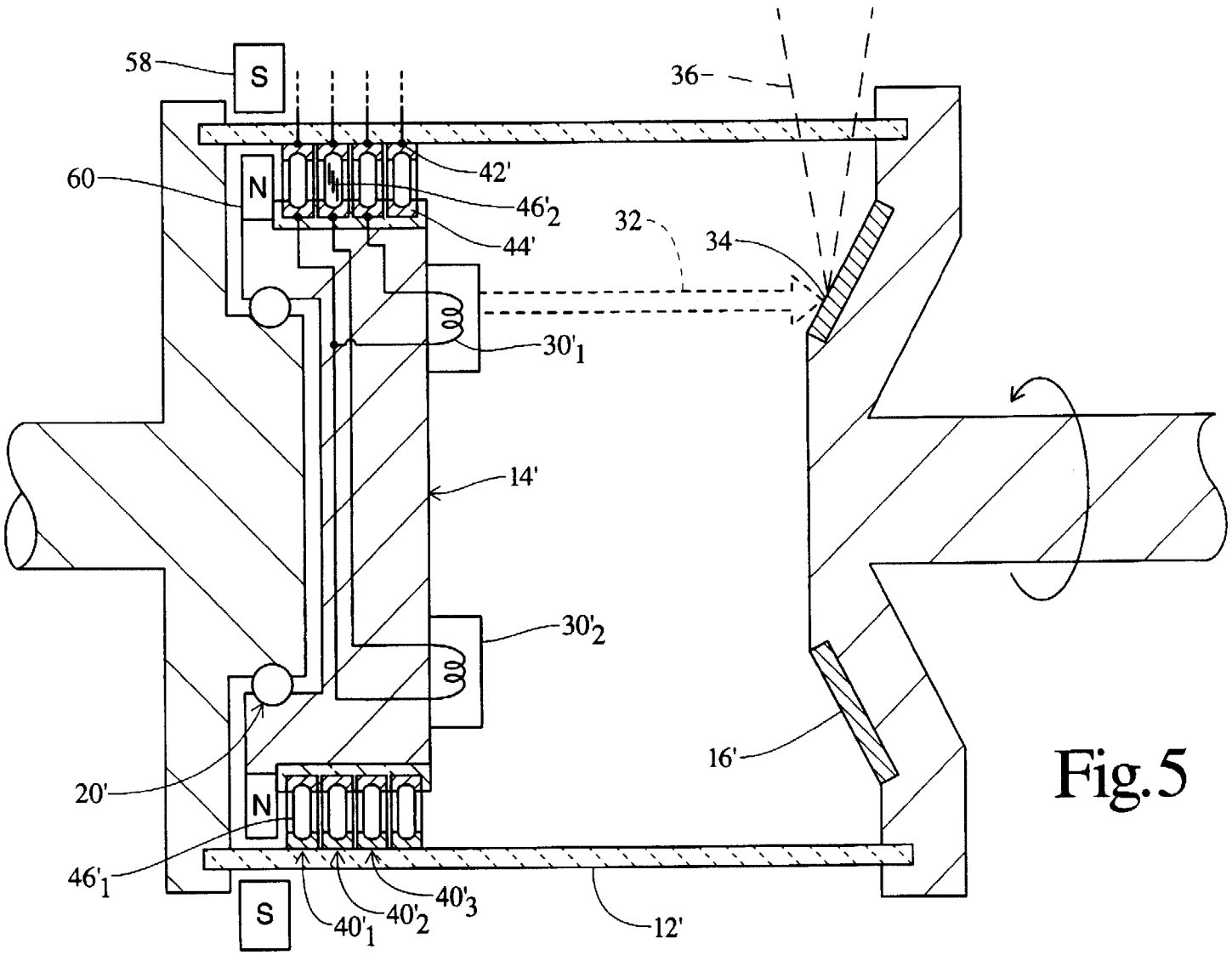
FIG. 5 is a cross-sectional view of another alternate embodiment of an x-ray tube in accordance with the present invention.

With reference to FIG. 5, in some high powered x-ray tubes, the anode 16' and the evacuated envelope 12' are fixedly interconnected and rotated together. With this arrangement, cooling fluid can be applied directly to the reverse side of the anode. A cathode assembly 14' is rotatably mounted to the evacuated envelope by a bearing assembly 20'. Magnets 60 mounted on the cathode assembly and magnets 58 stationarily mounted outside of the rotating evacuated envelope hold the cathode assembly 14' stationary as the evacuated envelope 12' rotates. A plurality of rolling ring assemblies $\mathbf{40'_1}$, $\mathbf{40'_2}$, $\mathbf{40'_3}$, . . . provide an electrical interconnection between the stationary cathode assembly 14' and the rotating evacuated envelope 12'. Each cathode assembly includes an outer race 12' which is mounted to the evacuated envelope 42'. Electrical wiring extends from the outer race 42' through the evacuated envelope 12'. Two slip rings, other rolling ring assemblies, or appropriate connections are also provided for making an electrical connection between the leads extending from the rotating evacuated envelope and stationary electronic control circuitry (not shown). Rotating rings $\mathbf{46'_1}$, $\mathbf{46'_2}$, . . . of slightly compressed copper or other conductive materials are mounted between each outer race 42' and an inner race 44'.

In the illustrated embodiment, the inner races of rolling ring assemblies $\mathbf{40'_1}$ and $\mathbf{40'_2}$ are connected to a first cathode $\mathbf{30'_1}$. Preferably, additional cathodes $\mathbf{30'_2}$, and the like are also mounted to the cathode assembly 14'. The additional cathode can be the same as the first cathode to be rotated into the place of the first cathode and actuated if the first cathode should burn out. Alternately, the different cathodes with different size filaments can be provided. Additional rolling ring assemblies can carry electrical current to and from additional cathodes or to other electronic control circuitry mounted on the cathode assembly 14'.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube comprising:

an evacuated envelope;

a cathode mounted within the evacuated envelope;

a rotating anode mounted in the evacuated envelope opposite to the cathode;

a shaft connected to the anode and rotatably supported in a bearing assembly, the shaft defining an electrically conductive path for carrying electrons received by said anode from said cathode; and, a roll ring assembly, electrically connected between one of the shaft and the anode and the evacuated envelope to provide an electrically conductive path which carries said electrons from the anode to an exterior of the evacuated envelope.

2. The x-ray tube as set forth in claim 1 wherein the roll ring assembly includes:

a rotating track supported by the shaft;

a stationary track supported with the evacuated envelope; and a metallic ring rollingly supported between the tracks.

3. The x-ray tube as set forth in claim 1 wherein the bearing assembly includes:

a plurality of ball bearings disposed between the shaft and the evacuated envelope.

4. The x-ray tube as set forth in claim 1 further including:

a rotor mounted to the shaft within the evacuated envelope;

a set of stator windings disposed outside the evacuated envelope closely adjacent the rotor.

5. The x-ray tube as set forth in claim 1 further including:

a second roll ring assembly electrically connected between the anode and ground.

6. A method generating x-rays with an x-ray tube that includes a cathode and an anode in an evacuated envelope, one of the anode and the cathode being rotatably mounted relative to the evacuated envelope, the method comprising:

propelling a current of electrons from the cathode to the anode with sufficient energy to produce x-rays at the anode where the current impacts the anode;

rotating the anode while holding the cathode stationary; and, passing electrical current through a rolling ring between the evacuated envelope and the one of the cathode and anode which is rotatably mounted relative thereto.

7. The method as set forth in claim 6 wherein the anode includes a shaft which is rotatably mounted on a set of bearings that are supported with the evacuated envelope and the passing step includes:

passing electrical current attributable to the electron current impacting the anode through the anode, the shaft, a rotating track connected to the shaft, the rolling ring, and to ground.

8. The method as set forth in claim 7 wherein the anode is mounted to the evacuated envelope such that the anode and envelope rotate together and the cathode is rotatably supported within the envelope such that the cathode remains stationary as the anode and evacuated envelope rotate and the passing step includes:

passing electrical current through the evacuated envelope, the rolling ring, and a cathode.

9. An x-ray tube comprising:

an evacuated envelope;

an anode and a cathode disposed within the evacuated envelope, one of the anode and cathode being mounted stationarily to the evacuated envelope and the other of the anode and cathode being rotatably mounted relative to the evacuated envelope; and, at least one rolling ring assembly connected between the evacuated envelope and the one of the anode and cathode which is rotatably mounted with respect to the evacuated envelope for passing electrical current.

10. The x-ray tube as set forth in claim 9 wherein the anode is connected to the evacuated envelope for rotation therewith and the cathode is rotatably mounted to the evacuated envelope such that the cathode remains stationary as the evacuated envelope rotates.

11. The x-ray tube as set forth in claim 10 further including:

a plurality of rolling ring assemblies connected between the evacuated envelope and the cathode, the rolling ring assemblies being connected with a first cathode for providing cathode current thereto.

12. The x-ray tube as set forth in claim 11 further including additional rolling ring assemblies connected to a second cathode such that either of two cathodes are selectively operable.

13. The x-ray tube as set forth in claim 9 wherein the anode is rotatably mounted relative to the evacuated envelope and the cathode assembly is fixedly mounted to the evacuated envelope and further including a motor assembly for rotating the anode within the evacuated envelope.

14. The x-ray tube as set forth in claim 13 wherein the anode is mounted on a central shaft, the rolling ring assembly being connected between the central shaft and the evacuated envelope.

15. The x-ray tube as set forth in claim 13 wherein the rolling ring assembly is electrically connected with the anode and connected with the evacuated envelope.

16. The x-ray tube as set forth in claim 14 further including a second rolling ring assembly electrically connected with the anode and connected with the evacuated envelope.

* * * * *